US007377986B2

(12) United States Patent
Schoen et al.

(10) Patent No.: US 7,377,986 B2
(45) Date of Patent: May 27, 2008

(54) METHOD FOR PRODUCTION OF NON-ORIENTED ELECTRICAL STEEL STRIP

(75) Inventors: Jerry W. Schoen, Middletown, OH (US); Robert J. Comstock, Jr., Trenton, OH (US)

(73) Assignee: AK Steel Properties, Inc., Middletown, OH (US)

( * ) Notice: Subject to any disclaimer, the term of this patent is extended or adjusted under 35 U.S.C. 154(b) by 0 days.

(21) Appl. No.: 11/494,369

(22) Filed: Jul. 27, 2006

(65) Prior Publication Data

US 2007/0023103 A1 Feb. 1, 2007

Related U.S. Application Data

(63) Continuation of application No. 10/436,571, filed on May 14, 2003, now abandoned.

(51) Int. Cl.
*H01F 1/147* (2006.01)
*H01F 1/16* (2006.01)

(52) U.S. Cl. ..... 148/111; 148/112; 148/307

(58) Field of Classification Search ..... None
See application file for complete search history.

(56) References Cited

U.S. PATENT DOCUMENTS

| | | | | |
|---|---|---|---|---|
| 3,178,324 | A | 4/1965 | Grange et al. | |
| 3,935,038 | A | 1/1976 | Shimoyama et al. | |
| 3,947,296 | A | 3/1976 | Kumazawa | |
| 4,046,602 | A | 9/1977 | Stanley | |
| 4,560,423 | A | 12/1985 | Shimoyama et al. | |
| 4,632,708 | A | 12/1986 | Konno et al. | |
| 4,645,547 | A | 2/1987 | Krause et al. | |
| 4,647,319 | A * | 3/1987 | Iuchi | 148/508 |
| 4,666,535 | A | 5/1987 | Benford | |
| 4,715,905 | A | 12/1987 | Nakaoka et al. | |
| 4,781,769 | A | 11/1988 | Toker et al. | |
| 4,793,873 | A | 12/1988 | Dean | |
| 4,863,532 | A | 9/1989 | Kuroki et al. | |
| 4,871,402 | A | 10/1989 | Toker et al. | |
| 4,888,066 | A | 12/1989 | Yoshitomi et al. | |
| 4,906,305 | A | 3/1990 | McCormick et al. | |
| 4,948,675 | A | 8/1990 | Toker et al. | |

(Continued)

FOREIGN PATENT DOCUMENTS

| | | |
|---|---|---|
| EP | 0 779-369 A 1 | 1/1996 |

(Continued)

OTHER PUBLICATIONS

International Search Report for International Application No. PCT/US2004/014506, dated May 10, 2004.

*Primary Examiner*—John P. Sheehan
(74) *Attorney, Agent, or Firm*—Frost Bown Todd LLC

(57) ABSTRACT

The present invention relates to a method for producing a non-oriented electrical steel with improved magnetic properties and improved resistance to ridging, brittleness, nozzle clogging and magnetic aging. The chromium bearing steel is produced from a steel melt which is cast as a thin slab or conventional slab, cooled, hot rolled and/or cold rolled into a finished strip. The finished strip is further subjected to at least one annealing treatment wherein the magnetic properties are developed, making the steel sheet of the present invention suitable for use in electrical machinery such as motors or transformers.

24 Claims, 4 Drawing Sheets

U.S. PATENT DOCUMENTS

| | | | | | |
|---|---|---|---|---|---|
| 4,950,336 | A | | 8/1990 | Tomita et al. | |
| 4,964,922 | A | | 10/1990 | Ames et al. | |
| 4,968,361 | A | | 11/1990 | Ames et al. | |
| 5,009,726 | A | * | 4/1991 | Nishimoto et al. | 148/111 |
| 5,037,493 | A | | 8/1991 | Tomita et al. | |
| 5,055,362 | A | | 10/1991 | McCormick et al. | |
| 5,061,326 | A | | 10/1991 | Shoen | |
| 5,062,905 | A | | 11/1991 | Tomita et al. | |
| 5,116,435 | A | * | 5/1992 | Nishimoto et al. | 148/111 |
| 5,169,457 | A | * | 12/1992 | Nishimoto et al. | 148/111 |
| 5,186,762 | A | | 2/1993 | Ushigami et al. | |
| 5,192,373 | A | | 3/1993 | Wright et al. | |
| 5,200,145 | A | | 4/1993 | Krutenat et al. | |
| 5,261,972 | A | | 11/1993 | Kuroki et al. | |
| 5,288,736 | A | | 2/1994 | Schoen et al. | |
| 5,421,911 | A | | 6/1995 | Schoen | |
| 5,421,912 | A | | 6/1995 | Kumano et al. | |
| 5,482,107 | A | * | 1/1996 | Judd | 164/480 |
| 5,512,110 | A | | 4/1996 | Yoshitomi et al. | |
| 5,547,519 | A | | 8/1996 | Murphy | |
| 5,643,370 | A | | 7/1997 | Huppi | |
| 5,653,821 | A | | 8/1997 | Choi et al. | |
| 5,697,425 | A | | 12/1997 | Nanba et al. | |
| 5,702,539 | A | | 12/1997 | Schoen et al. | |
| 5,779,819 | A | | 7/1998 | Huppi | |
| 5,913,987 | A | | 6/1999 | Sung et al. | |
| 5,955,201 | A | | 9/1999 | Loudermilk et al. | |
| 5,968,291 | A | | 10/1999 | Iba et al. | |
| 6,136,456 | A | | 10/2000 | Komatsubara et al. | |
| 6,217,673 | B1 | | 4/2001 | Butler et al. | |
| 6,231,685 | B1 | | 5/2001 | Anderson | |
| 6,287,395 | B1 | | 9/2001 | Schriever et al. | |
| 6,290,783 | B1 | | 9/2001 | Kawano et al. | |
| 6,322,635 | B1 | | 11/2001 | Hayakawa et al. | |
| 6,340,399 | B1 | | 1/2002 | Tanaka et al. | |
| 6,361,621 | B1 | | 3/2002 | Fortunati et al. | |
| 2004/0016530 | A1 | * | 1/2004 | Schoen et al. | 164/476 |

FOREIGN PATENT DOCUMENTS

| | | | | |
|---|---|---|---|---|
| EP | 0 779-369 | A1 | * | 1/1996 |
| EP | 0 897 993 | A | | 2/1999 |
| WO | WO 01/68925 | A | | 9/2001 |
| WO | WO 03/095684 | A | | 11/2003 |
| WO | WO 03/097884 | A | | 11/2003 |

* cited by examiner

METHOD FOR PRODUCTION OF NON-ORIENTED ELECTRICAL STEEL STRIP

CROSS-REFERENCE TO RELATED APPLICATIONS

This application is a continuation of U.S. Non-Provisional patent application Ser. No. 10/436,571, filed May 14, 2003 now abandoned, entitled IMPROVED METHOD FOR PRODUCTION OF NON-ORIENTED ELECTRICAL STEEL STRIP.

BACKGROUND OF THE INVENTION

Non-oriented electrical steels are widely used as the magnetic core material in a variety of electrical machinery and devices, particularly in motors where low core loss and high magnetic permeability in all directions of the sheet are desired. The present invention relates to a method for producing a non-oriented electrical steel with low core loss and high magnetic permeability whereby a steel melt is solidified as an ingot or continuously slab and subjected to hot rolling and cold rolling to provide a finished strip. The finished strip is provided with at least one annealing treatment wherein the magnetic properties develop, making the steel sheet of the present invention suitable for use in electrical machinery such as motors or transformers.

Commercially available non-oriented electrical steels are typically broken into two classifications: cold rolled motor lamination steels ("CRML") and cold rolled non-oriented electrical steels ("CRNO"). CRML is generally used in applications where the requirement for very low core losses is difficult to justify economically. Such applications typically require that the non-oriented electrical steel have a maximum core loss of about 4 watts/pound (about 9 w/kg) and a minimum magnetic permeability of about a 1500 G/Oe (Gauss/Oersted) measured at 1.5 T and 60 Hz. In such applications, the steel sheet is typically processed at a nominal thickness of about 0.018 inch (about 0.45 mm) to about a 0.030 inch (about 0.76 mm). CRNO is generally used in more demanding applications where better magnetic properties are required. Such applications typically require that the non-oriented electrical steel have a maximum core loss of about 2 watts/pound (about 4.4 W/kg) and a minimum magnetic permeability of about 2000 G/Oe measured at 1.5 T and 60 Hz. In such applications, the steel sheet is typically processed to a nominal thickness of about 0.006 inch (about 0.15 mm) to about 0.025 inch (about 0.63 mm).

Non-oriented electrical steels are generally provided in two forms, commonly referred to as "semi-processed" or "fully-processed" steels. "Semi-processed" infers that the product must be annealed before use to develop the proper grain size and texture, relieve fabrication stresses and, if needed, provide appropriately low carbon levels to avoid aging. "Fully-processed" infers that the magnetic properties have been fully developed prior to the fabrication of the sheet into laminations, that is, the grain size and texture have been established and the carbon content has been reduced to about 0.03 weight % or less to prevent magnetic aging. These grades do not require annealing after fabrication into laminations unless so desired to relieve fabrication stresses. Non-oriented electrical steels are predominantly used in rotating devices, such as motors or generators, where uniform magnetic properties are desired in all directions with respect to the sheet rolling direction.

The magnetic properties of non-oriented electrical steels can be affected by thickness, volume resistivity, grain size, chemical purity and crystallographic texture of the finished sheet. The core loss caused by eddy currents can be made lower by reducing the thickness of the finished steel sheet, increasing the alloy content of the steel sheet to increase the volume resistivity or both in combination.

In the established methods used to manufacture non-oriented electrical steels, typical but non-limiting alloy additions of silicon, aluminum, manganese and phosphorus are employed. Non-oriented electrical steels may contain up to about 6.5 weight % silicon, up to about 3 weight % aluminum, carbon up to about 0.05 weight % (which must be reduced to below about 0.003 weight % during processing to prevent magnetic aging), up to about 0.01 weight % nitrogen, up to 0.01 weight % sulfur and balance iron with other impurities incidental to the method of steelmaking.

Achieving a suitably large grain size after finish annealing is desired for optimum magnetic properties. The purity of the finish annealed sheet can have a significant effect on the magnetic properties since presence of a dispersed phase, inclusions and/or precipitates may inhibit normal grain growth and prevent achieving the desired grain size and texture and, thereby, the desired core loss and magnetic permeability, in the final product form. Also, inclusions and/or precipitates during finish annealing hinder domain wall motion during AC magnetization, further degrading the magnetic properties in the final product form. As noted above, the crystallographic texture of the finished sheet, that is, the distribution of the orientations of the crystal grains comprising the electrical steel sheet, is very important in determining the core loss and magnetic permeability in the final product form. The <100> and <110> texture components as defined by Millers indices have higher magnetic permeability; conversely, the <111> type texture components have lower magnetic permeability.

Non-oriented electrical steels are differentiated by proportions of additions such as silicon, aluminum and like elements. Such alloying additions serve to increase volume resistivity, providing suppression of eddy currents during AC magnetization, and thereby lowering core loss. These additions also improve the punching characteristics of the steel by increasing the hardness. The effect of alloying additions on volume resistivity of iron is shown in Equation I:

$$p=13+6.25(\%\ \mathrm{Mn})+10.52(\%\ \mathrm{Si})+11.82(\%\ \mathrm{Al})+6.5(\%\ \mathrm{Cr})+14(\%\ \mathrm{P}) \quad \text{(I)}$$

where p is the volume resistivity, in μΩ-cm, of the steel and % Mn, % Si, % Al, % Cr and % P are, respectively, the weight percentages of manganese, silicon, aluminum, chromium and phosphorus in the steel.

Steels containing less than about 0.5 weight % silicon and other additions to provide a volume resistivity of up to about 20 μΩ-cm can be generally classified as motor lamination steels; steels containing about 0.5 to 1.5 weight % silicon or other additions to provide a volume resistivity of from about 20 μΩ-cm to about 30 μΩ-cm can be generally classified low-silicon steels; steels containing about 1.5 to 3.0 weight % silicon or other additions to provide a volume resistivity of from about 30 μΩ-cm to about 45 μΩ-cm can be generally classified as intermediate-silicon steels; and, lastly, steels containing more than about 3.0 weight % silicon or other additions to provide a volume resistivity greater than about 45 μΩ-cm can be generally classified as high-silicon steels.

Silicon and aluminum additions have detrimental effects on steels. Large silicon additions are well known to make steel more brittle, particularly at silicon levels greater than about 2.5%, and more temperature sensitive, that is, the ductile-to-brittle transition temperature may increase. Silicon may also react with nitrogen to form silicon nitride inclusions that may degrade the physical properties and cause magnetic "aging" of the non-oriented electrical steel. Properly employed, aluminum additions may minimize the effect of nitrogen on the physical and magnetic quality of the non-oriented electrical steel as aluminum reacts with nitrogen to form aluminum nitride inclusions during the cooling after casting and/or heating prior to hot rolling. However, aluminum additions can impact steel melting and casting from more aggressive wear of refractory materials and, in particular, clogging of refractory components used to feed the liquid steel during slab casting. Aluminum can also affect surface quality of the hot rolled strip by making removal of the oxide scale prior to cold rolling more difficult.

Alloying additions to iron such as silicon, aluminum and the like also affect the amount of austenite as shown in Equation II:

$$\gamma 1150^\circ\ C. = 64.8 - 23*Si - 61*Al + 9.9*(Mn+Ni) + 5.1*(Cu+Cr) - 14*P + 694*C + 347*N \quad (II)$$

where γ1150° C. is volume percentage of austenite formed at 1150° C. (2100° F.) and % Si, % Al, % Cr, % Mn, % P, % Cr, % Ni, % C and % N are, respectively, the weight percentages of silicon, aluminum, manganese, phosphorus, chromium, nickel, copper, carbon and nitrogen in the steel. Typically, alloys containing in excess of about 2.5% Si are fully ferritic, that is, no phase transformation from the body-center-cubic ferrite phase to the face-centered-cubic austenite phase occurs during heating or cooling. It is commonly known that the manufacture of fully ferritic electrical steels using thin or thick slab casting is complicated because of tendency for "ridging". Ridging is a defect resulting from localized non-uniformities in the metallurgical structure of the hot rolled steel sheet.

The methods for the production of non-oriented electrical steels discussed above are well established. These methods typically involve preparing a steel melt having the desired composition; casting the steel melt into an ingot or slab having a thickness from about 2 inches (about 50 mm) to about 20 inches (about 500 mm); heating the ingot or slab to a temperature typically greater than about 1900° F. (about 1040° C.); and, hot rolling to a sheet thickness of about 0.040 inch (about 1 mm) or more. The hot rolled sheet is subsequently processed by a variety of routings which may include pickling or, optionally, hot band annealing prior to or after pickling; cold rolling in one or more steps to the desired product thickness; and, finish annealing, sometimes followed by a temper rolling, to develop the desired magnetic properties.

In the most common exemplary method for the production of a non-oriented electrical steel, a slab having a thickness of more than about 4 inches (about 100 mm) and less than about 15 inches (about 370 mm) is continuously cast; reheated to an elevated temperature prior to a hot roughing step wherein the slab is converted into a transfer bar having a thickness of more than about 0.4 inch (about 10 mm) and less than about 3 inches (about 75 mm); and hot rolled to produce a strip having a thickness of more than about 0.04 inch (about 1 mm) and less than about 0.4 inch (about 10 mm) suitable for further processing. As noted above, thick slab casting methods afford the opportunity for multiple hot reduction steps that, if properly employed, can be used to provide a uniform hot rolled metallurgical microstructure needed to avoid the occurrence of a defect commonly known in the art as "ridging". However, the necessary practices are often incompatible with or undesirable for operation of the mill equipment.

In recent years, technological advances in thin slab casting have been made. In an example of this method, a non-oriented electrical steel is produced from a cast slab having a thickness of more than about 1 inch (about 25 mm) and less than about 4 inches (about 100 mm) which is immediately heated prior to hot rolling to produce a strip having a thickness of more than about 0.04 inch (about 1 mm) and less than about 0.4 inch (about 10 mm) suitable for further processing. However, while production of motor lamination grades of non-oriented electrical steels has been realized, the production of fully ferritic non-oriented electrical steels having the very highest magnetic and physical quality has met with only limited success because of "ridging" problems. In part, thin slab casting is more constrained because of the amount of and flexibility in hot reduction from the as-cast slab to finished hot rolled strip is more limited than when thick slab casting methods are employed.

For the above mentioned reason, there has been a long felt need to develop a means to produce even the very highest grades of non-oriented electrical steels using which are more compatible with the capabilities afforded by thick and thin slab casting and which are less costly to manufacture.

SUMMARY OF THE INVENTION

Figure 1:
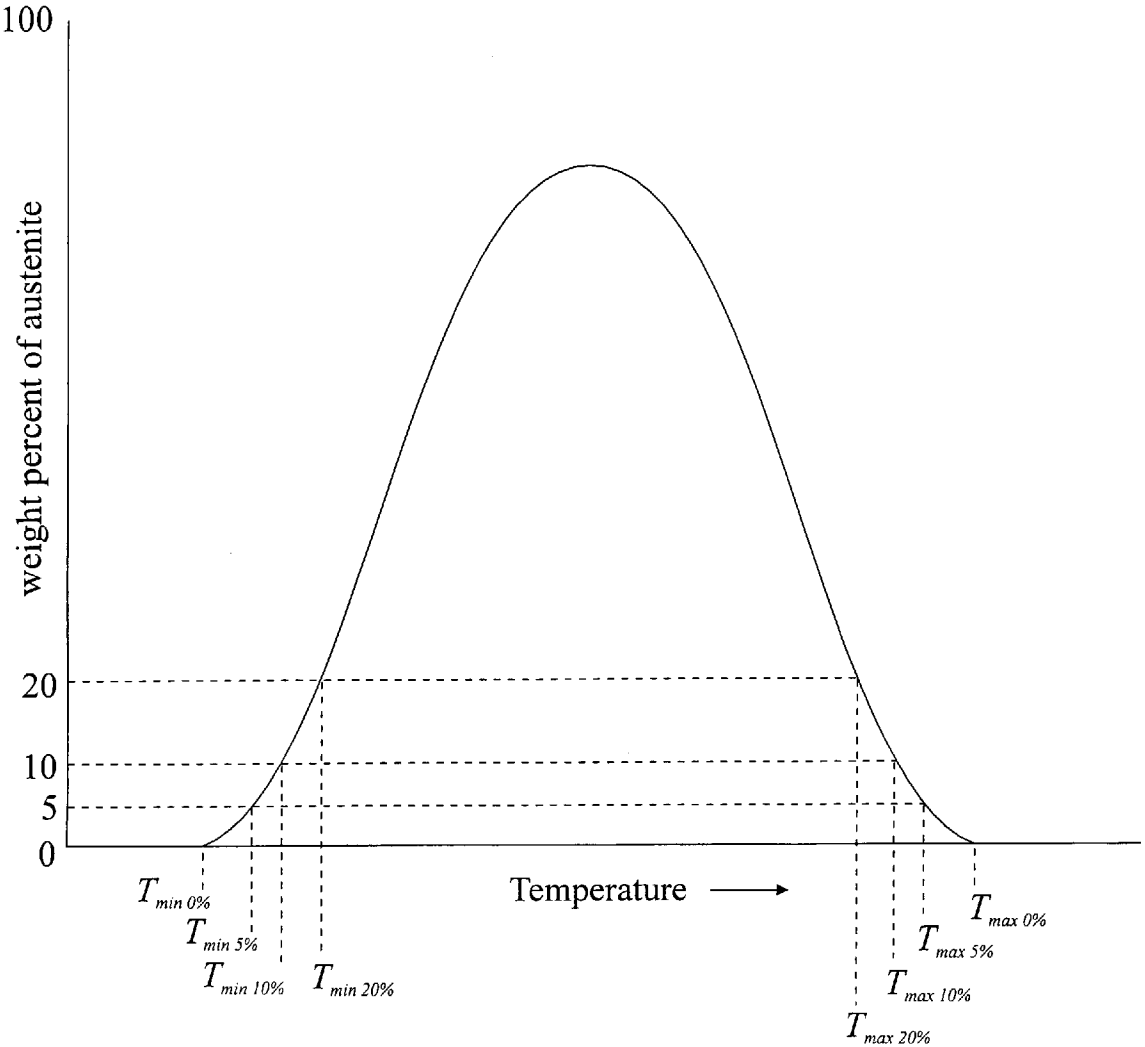
FIG. 1. A schematic drawing of the austenite phase field as a function of temperature showing the critical $T_{min}$ and $T_{max}$ temperatures.

The principal object of the present invention is the disclosure of an improved composition for the production of a non-oriented electrical steel with excellent physical and magnetic characteristics from a continuously cast slab.

The above and other important objects of the present invention are achieved by a steel having a composition in which the silicon, aluminum, chromium, manganese and carbon contents are as follows:

i. Silicon: up to about 6.5%
ii. Aluminum: up to about 3%
iii. Chromium: up to about 5%
iv. Manganese: up to about 3%
v. Carbon: up to about 0.05%;

In addition, the steel may have antimony in an amount up to about 0.15%; niobium in an amount up to about 0.005%; nitrogen in an amount up to about 0.01%; phosphorus in an amount up to about 0.25%; sulfur and/or selenium in an amount up to about 0.01%; tin in an amount up to about 0.15%; titanium in an amount up to about 0.01%; and vanadium in an amount up to about 0.01% with the balance being iron and residuals incidental to the method of steel making.

In a preferred composition, these elements are present in the following amounts:

i. Silicon: about 1% to about 3.5%
ii. Aluminum: up to about 1%;
iii. Chromium: about 0.1% to about 3%;
iv. Manganese: about 0.1% to about 1%;
v. Carbon: up to about 0.01%;
vi. Sulfur: up to about 0.01%;
vii. Selenium: up to about 0.01%; and
viii. Nitrogen: up to about 0.005%;

In a more preferred composition, these elements are present in the following amounts:

i. Silicon: about 1.5% to about 3%;
ii. Aluminum: up to about 0.5%
iii. Chromium: about 0.15% to about 2%;
iv. Manganese: about 0.1% to about 0.35%;
v. Carbon: up to about 0.005%;
vi. Sulfur: up to about 0.005%; and
vii. Selenium: up to about 0.007%; and
viii. Nitrogen: up to about 0.002%.

In one embodiment, the present invention provides a method to produce a non-oriented electrical steel from a steel melt containing silicon and other alloying additions or impurities incidental to the method of steelmaking which is subsequently cast into a slab having a thickness of from about 0.8 inch (about 20 mm) to about 15 inches (about 375 mm), reheated to an elevated temperature and hot rolled into a strip of a thickness of from about 0.014 inch (about 0.35 mm) to about 0.06 inch (about 1.5 mm). The non-oriented electrical steel of this method can be used after a finish annealing treatment is provided to develop the desired magnetic characteristics for use in a motor, transformer or like device.

In a second embodiment, the present invention provides a method whereby a non-oriented electrical steel is produced from a steel melt containing silicon and other alloying additions or impurities incidental to the method of steelmaking which is cast into a slab having a thickness of from about 0.8 inch (about 20 mm) to about 15 inches (about 375 mm), reheated and hot rolled into a strip of a thickness of from about 0.04 inch (about 1 mm) to about 0.4 inch (about 10 mm) which is subsequently cooled, pickled, cold rolled and finish annealed to develop the desired magnetic characteristics for use in a motor, transformer or like device. In an optional form of this embodiment, the hot rolled strip may be annealed prior to being cold rolled and finished annealed.

In the practice of the above embodiments, a steel melt containing silicon, chromium, manganese and like additions is prepared whereby the composition provides a volume resistivity of at least 20 μΩ-cm as defined using Equation I and a peak austenite volume fraction, γ1150° C., is greater than 0 wt % as defined using Equation II. In the preferred, more preferred, and most preferred practice of the present invention, γ1150° C. is at least 5%, 10% and at least 20%, respectively.

In the practice of the above embodiments, the cast or thin slabs may not be heated to a temperature exceeding $T_{max}$ 0% as defined in Equation IIIa prior to hot rolling into strip. $T_{max}$ 0% is the high temperature boundary of the austenite phase field at which 100% ferrite is present in the alloy and below which a small percentage of austenite is present in the alloy. This is illustrated in FIG. 1. By so limiting the heating temperature, the abnormal grain growth caused by re-transformation of the austenite to ferrite during slab reheating is avoided. In the preferred practice of the above embodiments, the cast or thin slabs may not be heated to a temperature exceeding $T_{max}$ 5% as defined in Equation IIIb prior to hot rolling into strip. Similarly, $T_{max}$ 5% is the temperature at which 95% ferrite and 5% austenite is present in the alloy, just below the high temperature austenite phase field boundary. In the more preferred practice, the cast or thin slabs may not be heated to a temperature exceeding $T_{max}$ 10%. In the most preferred practice of the above embodiments, the cast or thin slabs may not be heated to a temperature exceeding $T_{max}$ 20% as defined in Equation IIIc prior to hot rolling into strip. $T_{max}$ 10% and $T_{max}$ 20% are the temperatures at which 10% and 20% austenite are present in the alloy, respectively, at a temperature exceeding the peak austenite weight percent. $T_{max}$ 5%, $T_{max}$ 10%, and $T_{max}$ 20% are also illustrated in FIG. 1.

$$T_{max}\ 0\%,^{\circ}\ C.=1463+3401(\%\ C)+147(\%\ Mn)-378(\%\ P)-109(\%\ Si)-248(\%\ Al)-0.79(\%\ Cr)-78.8(\%\ N)+28.9(\%\ Cu)+143(\%\ Ni)-22.7(\%\ Mo) \quad \text{(IIIa)}$$

$$T_{max}\ 5\%,^{\circ}\ C.=1479+3480(\%\ C)+158(\%\ Mn)-347(\%\ P)-121(\%\ Si)-275(\%\ Al)+1.42(\%\ Cr)-195(\%\ N)+44.7(\%\ Cu)+140(\%\ Ni)-132(\%\ Mo) \quad \text{(IIIb)}$$

$$T_{max}\ 20\%,^{\circ}\ C.=1633+3970(\%\ C)+236(\%\ Mn)-685(\%\ P)-207(\%\ Si)-455(\%\ Al)+9.64(\%\ Cr)-706(\%\ N)+55.8(\%\ Cu)+247(\%\ Ni)-156(\%\ Mo) \quad \text{(IIIc)}$$

The cast and reheated slab must be hot rolled such that at least one reduction pass is performed at a temperature where the metallurgical structure of the steel is comprised of austenite. The practice of the above embodiments includes a hot reduction pass at a temperature which is greater than about $T_{min}$ 0% illustrated in FIG. 1 and a maximum temperature less than about $T_{max}$ 0% as defined in Equation IIIa, illustrated in FIG. 1. The preferred practice of the above embodiments includes a hot reduction pass at a temperature which is greater than about $T_{min}$ 5% of Equation IVa and a maximum temperature less than about $T_{max}$ 5% as defined in Equation IIIb. The more preferred practice of the above embodiments includes a hot reduction pass at a temperature which is greater than about $T_{min}$ 10% and a maximum temperature less than about $T_{max}$ 10%, illustrated in FIG. 1. The most preferred practice of the above embodiments includes a hot reduction pass at a temperature which is greater than about $T_{min}$ 20% of Equation IVb and a maximum temperature less than about $T_{max}$ 20% as defined in Equation IIIc.

$$T_{min}\ 5\%,^{\circ}\ C.=921-5998(\%\ C)-106(\%\ Mn)+135(\%\ P)+78.5(\%\ Si)+107(\%\ Al)-11.9(\%\ Cr)+896(\%\ N)+8.33(\%\ Cu)-146(\%\ Ni)+173(\%\ Mo) \quad \text{(IVa)}$$

$$T_{min}\ 20\%,^{\circ}\ C.=759-4430(\%\ C)-194(\%\ Mn)+445(\%\ P)+181(\%\ Si)+378(\%\ Al)-29.0(\%\ Cr)-48.8(\%\ N)-68.1(\%\ Cu)-235(\%\ Ni)+116(\%\ Mo) \quad \text{(IVb)}$$

The practice of the above embodiments includes at least one hot reduction pass to provide a nominal strain ($\epsilon_{nominal}$), after hot rolling of at least 700 calculated using Equation V as:

$$\varepsilon_{nominal}=\left[\frac{2\pi n}{t_i}\sqrt{D(t_i-t_f)}\left(1.25-\frac{t_f}{4t_{[f]i}}\right)\right]^{0.15}\exp\left(\frac{7616}{T}\right)\ln\left(\frac{t_i}{t_f}\right) \quad \text{(V)}$$

The practice of the above embodiments may include an annealing step prior to cold rolling which annealing step is conducted a temperature which is less than Tmin 20% of Equation IVb. The preferred practice of the above embodiments may include an annealing step prior to cold rolling which annealing step is conducted a temperature which is less than Tmin 10%. The more preferred practice of the above embodiments may include an annealing step prior to cold rolling which annealing step is conducted a temperature which is less than Tmin 5% of Equation IVa. The most preferred practice of the above embodiments may include an annealing step prior to cold rolling which annealing step is conducted a temperature which is less than Tmin 0%.

The practice of the above embodiments must include a finishing anneal wherein the magnetic properties of the strip are developed which annealing step is conducted at a temperature which is less than $T_{min}$ 20% (Equation IVb). The preferred practice of the above embodiments must include a finishing anneal wherein the magnetic properties of the strip are developed which annealing step is conducted at a temperature which is less than $T_{min}$ 10% (illustrated in FIG. 1). The more preferred practice of the above embodiments must include a finishing anneal wherein the magnetic properties of the strip are developed which annealing step is conducted at a temperature which is less than $T_{min}$ 5% (Equation IVa). The most preferred practice of the above embodiments must include a finishing anneal wherein the magnetic properties of the strip are developed which annealing step is conducted at a temperature which is less than $T_{min}$ 0% (illustrated in FIG. 1).

Unless otherwise defined, all technical and scientific terms used herein have the same meaning as commonly understood by one of ordinary skill in the art. Although methods and materials similar or equivalent to those described herein can be used in the practice or testing of the present invention, suitable methods and materials are described below. All publications, patent applications, patents, and other references mentioned herein are incorporated by reference in their entirety. In the case of conflict, the present specification, including definitions, will control. In addition, the materials, methods, and examples are illustrative only and not intended to be limiting. Other features and advantages of the invention will be apparent from the following detailed description and claims.

DETAILED DESCRIPTION OF THE INVENTION

In order to provide a clear and consistent understanding of the specification and claims, including the scope to be given such terms, the following definitions are provided.

The terms "ferrite" and "austenite" are used to describe the specific crystalline forms of steel. "Ferrite" or "ferritic steel" has a body-centered-cubic, or "bcc", crystalline form whereas "austenite" or "austenitic steel" has a face-centered cubic, or "fcc", crystalline form. The term "fully ferritic steel" is used to describe steels that do not undergo any phase transformation between the ferrite and austenite crystal phase forms in the course of cooling from the melt and/or in reheating for hot rolling, regardless of its final room temperature microstructure.

The terms "strip" and "sheet" are used to describe the physical characteristics of the steel in the specification and claims being comprised of a steel being of a thickness of less than about 0.4 inch (about 10 mm) and of a width typically in excess of about 10 inches (about 250 mm) and more typically in excess of about 40 inches (about 1000 mm). The term "strip" has no width limitation but has a substantially greater width than thickness.

In the practice of the present invention, a steel melt containing alloying additions of silicon, chromium, manganese, aluminum and phosphorus is employed.

To begin to make the electrical steels of the present invention, a steel melt may be produced using the generally established methods of steel melting, refining and alloying. The melt composition comprises generally up to about 6.5% silicon, up to about 3% aluminum, up to about 5% chromium, up to about 3% manganese, up to about 0.01% nitrogen, and up to about 0.05% carbon with the balance being essentially iron and residual elements incidental to the method of steelmaking. A preferred composition comprises from about 1% to about 3.5% silicon, up to about 1% aluminum, about 0.1% to about 3% chromium, about 0.1% to about 1% manganese, up to about 0.01% sulfur and/or selenium, up to about 0.005% nitrogen and up to about 0.01% carbon. In addition, the preferred steel may have residual amounts of elements, such as titanium, niobium and/or vanadium, in amounts not to exceed about 0.005%. A more preferred steel comprises about 1.5% to about 3% silicon, up to about 0.5% aluminum, about 0.15% to about 2% chromium, up to about 0.005% carbon, up to about 0.008% sulfur or selenium, up to about 0.002% nitrogen, about 0.1% to about 0.35% manganese and the balance iron with normally occurring residuals. The steel may also include other elements such as antimony, arsenic, bismuth, phosphorus and/or tin in amounts up to about 0.15%. The steel may also include copper, molybdenum and/or nickel in amounts up to about 1% individually or in combination. Other elements may be present either as deliberate additions or present as residual elements, i.e., impurities, from steel melting process. Exemplary methods for preparing the steel melt include oxygen, electric arc (EAF) or vacuum induction melting (VIM). Exemplary methods for further refining and/or making alloy additions to the steel melt may include a ladle metallurgy furnace (LMF), vacuum oxygen decarburization (VOD) vessel and/or argon oxygen decarburization (AOD) reactor.

Silicon is present in the steels of the present invention in an amount of about 0.5% to about 6.5% and, preferably, about 1% to about 3.5% and, more preferably, about 1.5% to about 3%. Silicon additions serve to increase volume resistivity, stabilize the ferrite phase and increase hardness for improved punching characteristics in the finished strip; however, at levels above about 2.5%, silicon is known that make the steel more brittle.

Chromium is present in the steels of the present invention in an amount of up to about 5% and, preferably, about 0.1% to about 3% and, more preferably, about 0.15% to about 2%. Chromium additions serve to increase volume resistivity; however, its effect must be considered in order to maintain the desired phase balance and microstructural characteristics.

Manganese is present in the steels of the present invention in an amount of up to about 3% and, preferably, about 0.1% to about 1% and, more preferably, about 0.1% to about 0.35%. Manganese additions serve to increase volume resistivity; however, manganese is known in the art to slow the rate of grain growth during the finishing anneal. Because of this, the usefulness of large additions of manganese must be considered carefully both with respect to the desired phase balance and microstructure characteristics in the finished product.

Aluminum is present in the steels of the present invention in an amount of up to about 3% and, preferably, up to about 1% and, more preferably, up to about 0.5%. Aluminum additions serve to increase volume resistivity, stabilize the ferrite phase and increase hardness for improved punching characteristics in the finished strip. However, the usefulness of large additions of aluminum must be considered carefully as aluminum may accelerate deterioration of steelmaking refractories. Moreover, careful consideration of processing conditions are needed to prevent the precipitation of fine aluminum nitride during hot rolling. Lastly, large additions of aluminum can cause the development of a more adherent oxide scale, making descaling of the sheet more difficult and expensive.

Sulfur and selenium are undesirable elements in the steels of the present invention in that these elements can combine with other elements to form precipitates that may hinder grain growth during processing. Sulfur is a common residual in steel melting. Sulfur and/or selenium, when present in the steels of the present invention, may be in an amount of up to about 0.01%. Preferably sulfur may be present in an amount up to about 0.005% and selenium in an amount up to about 0.007%.

Nitrogen is an undesirable element in the steels of the present invention in that nitrogen can combine with other elements and form precipitates that may hinder grain growth during processing. Nitrogen is a common residual in steel melting and, when present in the steels of the present invention, may be in an amount of up to about 0.01% and, preferably, up to about 0.005% and, more preferably, up to about 0.002%.

Carbon is an undesirable element in the steels of the present invention. Carbon fosters the formation of austenite and, when present in an amount greater than about 0.003%, the steel must be provided with a decarburizing annealing treatment to reduce the carbon level sufficiently to prevent "magnetic aging", caused by carbide precipitation, in the finish annealed steel. Carbon is a common residual from steel melting and, when present in the steels of the present invention, may be in an amount of up to about 0.05% and, preferably, up to about 0.01% and, more preferably, up to about 0.005%. If the melt carbon level is greater than about 0.003%, the non-oriented electrical steel must be decarburization annealed to less than about 0.003% carbon and, preferably, less than about 0.0025% so that the finished annealed strip will not magnetically age.

The method of the present invention addresses a practical issue arising in the present steel production methods and, in particular, the compact strip production methods, i.e., thin slab casting, for the manufacture of high grade non-oriented electrical steel sheets.

In the particular case of thin slab casting, the caster is closely coupled to the slab reheating operation (alternatively referred to as temperature equalization) which, in turn, is closely coupled to the hot rolling operation. Such compact mill designs may place limitations both on the slab heating temperature as well as the amount of reduction in which can be used for hot rolling. These constraints make the production of fully ferritic non-oriented electrical steels difficult as incomplete recrystallization often leads to ridging in the final product.

In the particular case of thick slab casting and, in some cases, with thin slab casting, high slab reheating temperatures are sometimes employed to ensure that the steel is at a sufficiently high temperature for rough hot rolling, during which the slab is reduced in thickness to a transfer bar, followed by finish hot rolling, during which the transfer bar is rolled to a hot band. Slab heating must be employed to maintain the slab at a temperature where the slab microstructure consists of mixed phases of ferrite and austenite to prevent abnormal grain growth in the slab prior to rolling. In the practice of the method of the present invention, the temperature for slab reheating should not exceed $T_{max}$ of Equation III.

The rolled strip is further provided with a finishing anneal within which the desired magnetic properties are developed and, if necessary, to lower the carbon content sufficiently to prevent magnetic aging. The finishing annealing is typically conducted in a controlled atmosphere during annealing, such as a mixed gas of hydrogen and nitrogen. There are several methods well known in the art, including batch or box annealing, continuous strip annealing, and induction annealing. Batch annealing, if used, is typically conducted to provide an annealing temperature of at or above about 1450° F. (about 790° C.) and less than about 1550° F. (about 843° C.) for a time of approximately one hour as described in ASTM specifications 726-00, A683-98a and A683-99. Continuous strip annealing, if used, is typically conducted at an annealing temperature at or above 1450° F. (about 790° C.) and less than about 1950° F. (about 1065° C.) for a time of less than ten minutes. Induction annealing, when used, is typically conducted to provide an annealing temperature greater than about 1500° F. (815° C.) for a time less than about five minutes.

The present invention provides for a non-oriented electrical steel having magnetic properties appropriate for commercial use wherein a steel melt is cast into a starting slab which is then processed by either hot rolling, cold rolling or both prior to finish annealing to develop the desired magnetic properties.

The silicon and chromium bearing non-oriented electrical steel of one embodiment of the present invention is advantageous as improved mechanical property characteristics of superior toughness and greater resistance to strip breakage during processing are obtained.

In one embodiment, the present invention provides processes to produce a non-oriented electrical steel having magnetic properties which have a maximum core loss of about 4 W/pound (about 8.8 W/kg) and a minimum magnetic permeability of about 1500 G/Oe measured at 1.5 T and 60 Hz.

In another embodiment, the present invention provides processes to produce a non-oriented electrical steel having magnetic properties which have a maximum core loss of about 2 W/pound (about 4.4 W/kg) and a minimum magnetic permeability of about 2000 G/Oe measured at 1.5 T and 60 Hz.

In the optional practices of the present invention, the hot rolled strip may be provided with an annealing step prior to cold rolling and/or finish annealing.

The methods of processing a non-oriented electrical steel from a continuously cast slab having a starting microstructure comprised entirely of ferrite are well known to those skilled in the art. It is also known that there are significant difficulties in getting complete recrystallization of the as-cast grain structure during hot rolling. This results in the development of a non-uniform grain structure in the hot rolled steel strip which may result in the occurrence of a defect known as "ridging" during cold rolling. Ridging is the result of non-uniform deformation and results in unacceptable physical characteristics for end use. Equation II illustrates the effect of composition on formation of the austenite phase and in the practice of the method of the present invention, can be used to determine the limiting temperature for hot rolling, if used, and/or annealing, if used, of the strip.

The applicants have determined in one embodiment of the present invention wherein the strip is hot rolled, annealed, optionally cold rolled, and finish annealed to provide a non-oriented electrical steel having superior magnetic properties. The applicants have further determined in another embodiment of the present invention wherein the strip is hot rolled, cold rolled and finish annealed to provide a non-oriented electrical steel having superior magnetic properties without requiring an annealing step after hot rolling. The applicants have further determined in third embodiment of the present invention wherein the strip is hot rolled, annealed, cold rolled and finish annealed to provide a non-oriented electrical steel having superior magnetic properties.

In the research studies conducted by the applicants, the hot rolling conditions are specified to foster recrystallization and, thereby, suppress the development of the "ridging" defect. In the preferred practice of the present invention, the deformation conditions for hot rolling were modeled to determine the requirements for hot deformation whereby the strain energy imparted from hot rolling was needed for extensive recrystallization of the strip was determined. This model, outlined in Equations IV through X, represents a further embodiment of the method of the present invention and should be readily understood by one skilled in the art.

The strain energy imparted from rolling can be calculated as:

$$W = \theta_c \ln\left(\frac{1}{1-R}\right) \tag{VI}$$

Whereby W is the work expended in rolling, θc is the constrained yield strength of the steel and R is the amount of reduction taken in rolling in decimal fraction, i.e., initial thickness of the strip ($t_i$, in mm) divided by the final thickness of the hot rolled strip ($t_f$, in mm). The true strain in hot rolling can be further calculated as:

$$\epsilon = K_1 W$$

Where ϵ is the true strain and $K_1$ is a constant. Combining Equation VI into Equation VII, the true strain can be calculated as:

$$\varepsilon = K_1 \theta_c \ln\left(\frac{t_i}{t_f}\right) \tag{VIII}$$

The constrained yield strength, $\theta_c$, is related to the yield strength of the cast steel strip when hot rolling. In hot rolling, recovery occurs dynamically and thus strain hardening during hot rolling is considered not to occur in the method of the invention. However, the yield strength depends markedly on temperature and strain rate and thereby the applicants incorporated a solution based on the Zener-Holloman relationship whereby the yield strength is calculated based on the temperature of deformation and the rate of deformation, also termed as the strain rate, as follows.

$$\theta_T = 4.019\dot{\varepsilon}^{0.15}\exp\left(\frac{7616}{T}\right) \tag{IX}$$

Where $\theta_T$ is the temperature and strain rate compensated yield strength of the steel during rolling, $\dot{\epsilon}$ is the strain rate of rolling and T is the temperature, in ° K, of the steel when rolled. For the purposes of the present invention, $\theta_T$ is substituted for $\theta_c$ in Equation VIII to obtain:

$$\varepsilon = K_2\dot{\varepsilon}^{0.15}\exp\left(\frac{7616}{T}\right)\ln\left(\frac{t_i}{t_f}\right) \tag{X}$$

where $K_2$ is a constant.

A simplified method to calculate the mean strain rate, $\dot{\epsilon}_m$, in hot rolling is shown in Equation XI:

$$\dot{\varepsilon}_m = K_3\frac{2\pi Dn}{\sqrt{Dt_i}}\sqrt{\frac{t_i - t_f}{t_i}}\left[1 + \frac{1}{4}\left(\frac{t_i - t_f}{t_i}\right)\right] \tag{XI}$$

Where D is the work roll diameter in mm, n is the roll rotational rate in revolutions per second and $K_3$ is a constant. The above expressions can be rearranged and simplified by substituting $\dot{\epsilon}_m$ of Equation XI for $\dot{\epsilon}$ of Equation X and assigning a value of 1 to the constants, $K_1$, $K_2$ and $K_3$, whereby the nominal hot rolling strain, ϵ nominal, can be calculated as shown in Equation XII:

$$\varepsilon_{nonimal} = \left[\frac{2\pi n}{t_i}\sqrt{D(t_i - t_f)}\left(1.25 - \frac{t_f}{4t_{[f]i}}\right)\right]^{0.15}\exp\left(\frac{7616}{T}\right)\ln\left(\frac{t_i}{t_f}\right) \tag{XII}$$

In the embodiments of the present invention, the cast slab is heated to a temperature not greater than $T_{max}$ of Equation III to avoid abnormal grain growth. The cast and reheated slab is subjected to one or more hot rolling passes, whereby a reduction in thickness of greater than at least about 15%, preferably, greater than about 20% and less than about 70%, more preferably, greater than about 30% and less than about 65%. The conditions of the hot rolling, including temperature, reduction and rate of reduction are specified such that at least one pass and, preferably at least two passes, and, more preferably, at least three passes, impart a strain, ϵ nominal of Equation V, greater than 1000, and, preferably, greater than 2000 and, more preferably, greater than 5000 to provide optimum conditions for recrystallization of the as-cast grain structure prior to cold rolling or finish annealing of the strip.

In the practice of the present invention, annealing of the hot rolled strip may be carried out by means of self-annealing in which the hot rolled strip is annealed by the heat retained therein. Self-annealing may be obtained by coiling the hot rolled strip at a temperature above about 1300° F. (about 705° C.). Annealing of the hot rolled strip may also be conducted using either batch type coil anneal or continuous type strip anneal methods which are well known in the art; however, the annealing temperature must not exceed $T_{min}$ of Equation IV. Using a batch type coil anneal, the hot rolled strip is heated to an elevated temperature, typically greater than about 1300° F. (about 705° C.) for a time greater than about 10 minutes, preferably greater than about 1400° F. (about 760° C.). Using a strip type continuous anneal, the hot rolled strip is heated to a temperature typically greater than about 1450° F. (about 790° C.) for a time less than about 10 minutes.

A hot rolled strip or hot rolled and hot band annealed strip of the present invention may optionally be subjected to a descaling treatment to remove any oxide or scale layer formed on the non-oriented electrical steel strip before cold rolling or finish annealing. "Pickling" is the most common method of descaling where the strip is subjected to a chemical cleaning of the surface of a metal by employing aqueous solutions of one or more inorganic acids. Other methods such as caustic, electrochemical and mechanical cleaning are established methods for cleaning the steel surface.

After finish annealing, the steel of the present invention may be further provided with an applied insulative coating such as those specified for use on non-oriented electrical steels in ASTM specifications A677 and A976-97.

EXAMPLE 1

Heats A and B were melted to the compositions shown in Table I and made into 2.5 inch (64 mm) cast slabs. Table I shows that Heats A and B provided a $\gamma_{1150° C.}$ calculated in accordance with Equation II of about 21% and about 1% respectively. Slab samples from both heats were cut and heated in the laboratory to a temperature of from about 1922° F. (1050° C.) to 2372° F. (1300° C.) before hot rolling in a single pass and a reduction of between about 10% to about 40%. The hot rolling was conducted in a single rolling pass using work rolls having a diameter of 9.5 inches (51 mm) and a roll speed of 32 RPM. After hot rolling, the samples were cooled and acid etched to determine the amount of recrystallization.

Figure 2:
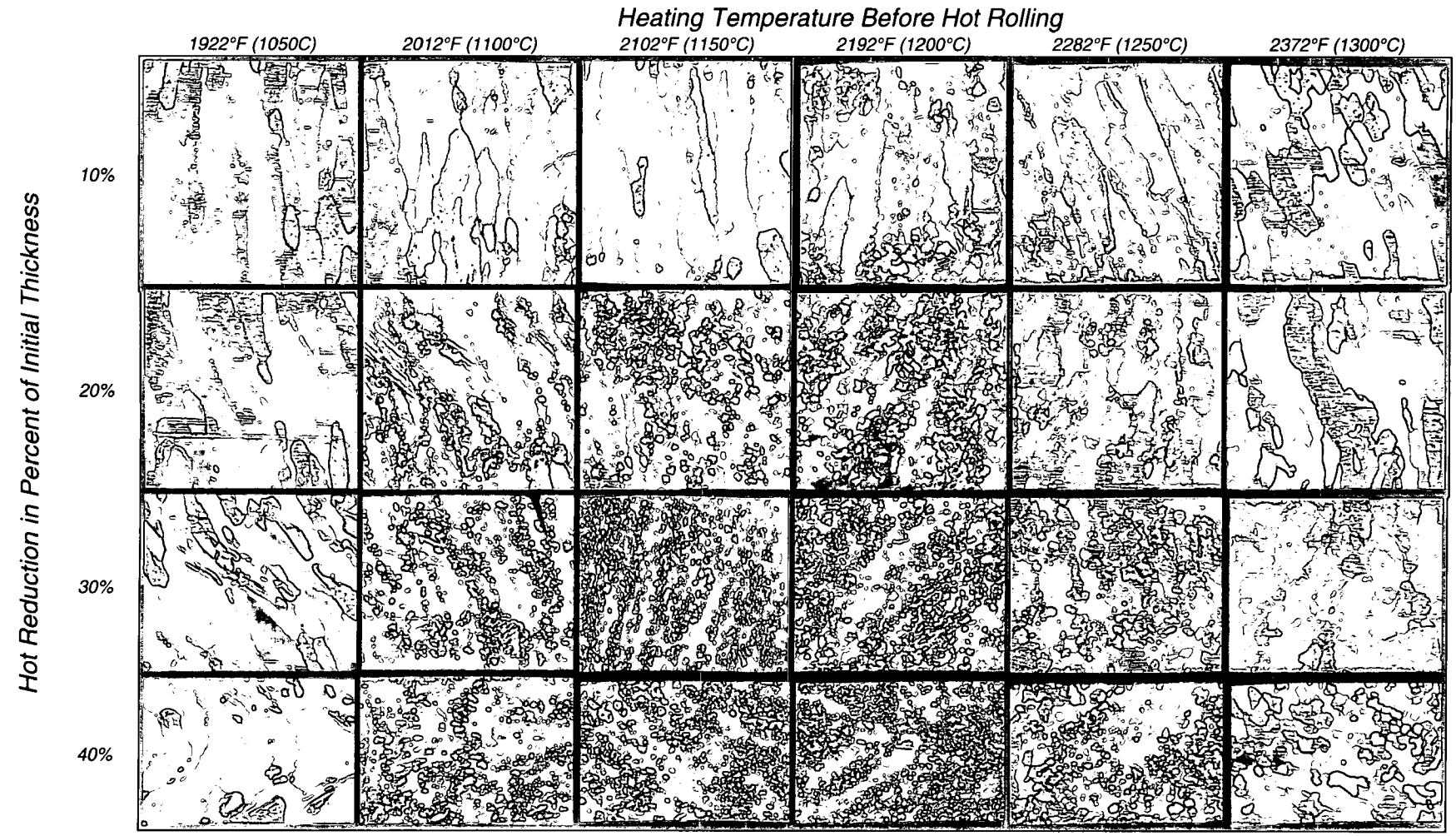
FIG. 2. Photographs of the microstructure of Heat A after the cast slabs are heated and hot rolled using the reductions shown.
Figure 3:
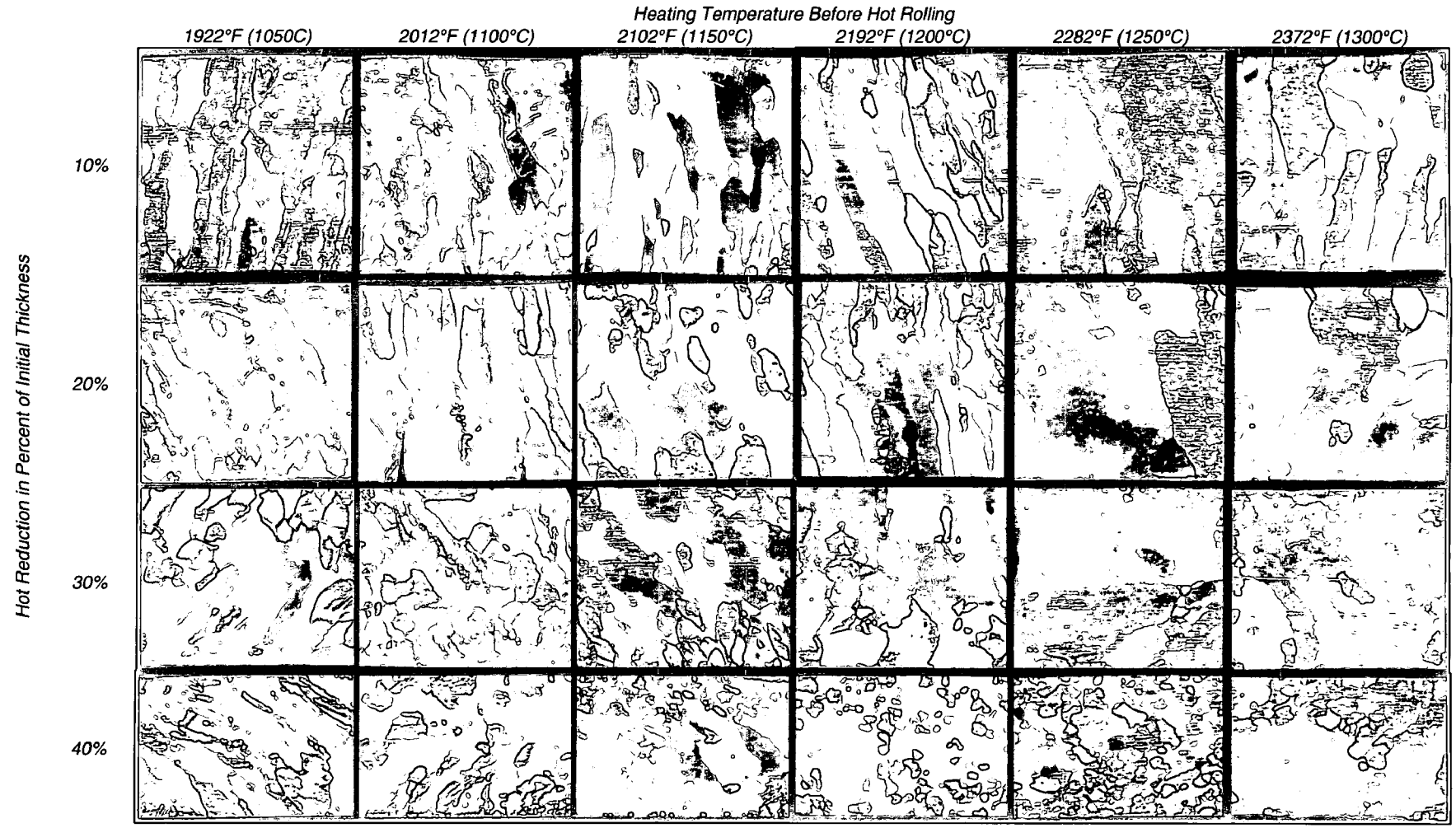
FIG. 3. Photographs of the microstructure of Heat B after the cast slabs are heated and hot rolled using the reductions shown.

The results of Heats A and B are shown in FIGS. 2 and 3, respectively. As FIG. 2 shows, a steel having a composition comparable to Heat A would provide sufficient austenite to prevent abnormal grain growth at slab heating temperatures of up to about 2372° F. (1300° C.), and using sufficient conditions for the hot reduction step, would provide excellent recrystallization of the cast structure. As FIG. 3 shows, a steel having a composition comparable to Heat B, having a lesser amount of austenite, must be processed with constraints as to the permissible slab heating temperature, about 2192° F.(1200° C.) or lower for the specific case of Heat B, so as to avoid abnormal grain growth in the slab prior to hot rolling. Moreover, the desired amount of recrystallization of the cast structure could only be obtained using much higher hot reductions within a much narrower hot rolling temperature range. FIG. 3 shows both conditions of abnormal grain growth and insufficient conditions for hot rolling result in large areas of unrecrystallized grains which may form ridging defects in the finished steel sheet.

EXAMPLE 2

Figure 4:
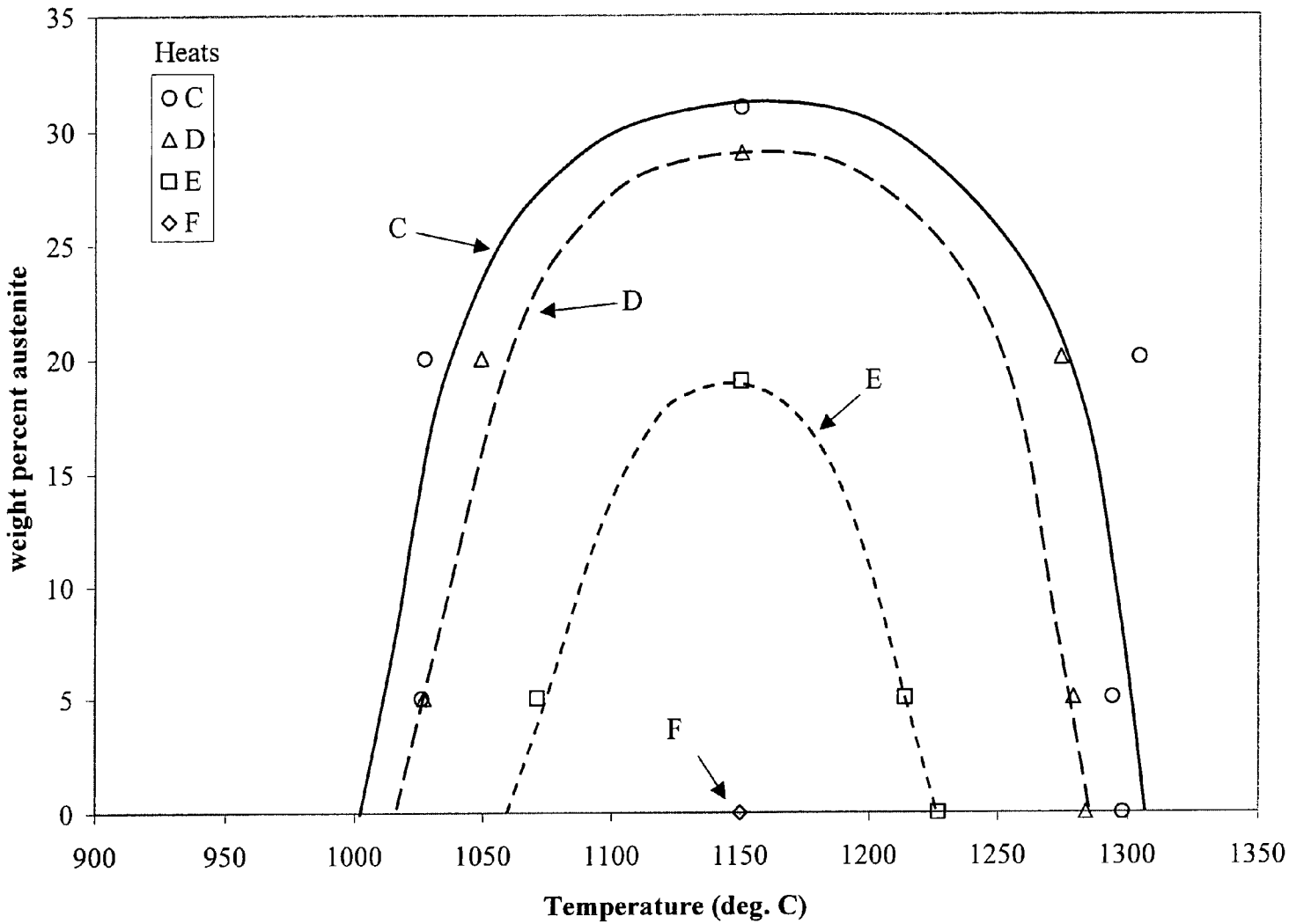
FIG. 4. A plot of the calculated amount of austenite at various temperatures characterizing the austenite phase fields of Heats C, D, E, and F from Table 1.

The compositions of Heats C, D and E in Table I were developed in accordance with the teachings of the present invention and employ a Si—Cr composition to provide a $\gamma_{1500° C.}$ of about 20% or greater with a volume resistivity calculated in accordance with Equation I of from about 35 μΩ-cm, typical of an intermediate-silicon steel of the art, to about 50 μΩ-cm, typical of a high-silicon steel of the art. Heat F, also shown in Table I, represents a fully ferritic non-oriented electrical steel of the prior art. Table I shows both the maximum permissible temperature for slab heating and the optimum temperature for hot rolling for these steels of the present invention. The results of Table I are plotted in FIG. 4. The austenite phase fields are shown for Heats C, D and E. FIG. 4 also illustrates that Heat F is calculated not have an austenite/ferrite phase field. As Table I illustrates, a non-oriented electrical steel can be made by the method of the invention to provide a volume resistivity typical of intermediate- to high-silicon steels of the prior art while providing a sufficient amount of austenite to ensure vigorous and complete recrystallization during hot rolling using a wide range of slab heating temperatures and hot rolling conditions. Moreover, the method taught in the present invention can be employed by one skilled in the art to develop an alloy composition for maximum compatibility with specific manufacturing requirements, operational capabilities or equipment limitations.

TABLE 1

| Heat | Al | C | Cr | Cu | Mn | Mo | N | Ni | P | S |
|---|---|---|---|---|---|---|---|---|---|---|
| A | 0.28 | 0.009 | 0.073 | 0.20 | 0.15 | 0.041 | 0.005 | 0.13 | 0.005 | 0.001 |
| B | 0.49 | 0.008 | 0.077 | 0.18 | 0.15 | 0.040 | 0.005 | 0.13 | 0.008 | 0.001 |
| C | .003 | .0030 | .29 | .084 | .14 | .027 | .0037 | .089 | .043 | .0009 |
| D | .003 | .0044 | .34 | .088 | .16 | .031 | .0020 | .091 | .058 | .0006 |
| E | .003 | .0023 | 1.46 | .094 | .15 | .036 | .0032 | .091 | .003 | .0010 |
| F | .610 | .0021 | .08 | .095 | .16 | .029 | .0039 | .081 | .005 | .0011 |

| Heat | Si | Sn | Tmin 5% | Tmin 20% | Tmax 20% | Tmax 5% | Tmax 0% | γ % | P μΩ-cm | |
|---|---|---|---|---|---|---|---|---|---|---|
| A | 1.67 | 0.009 | 1006 | 1059 | 1262 | 1274 | 1285 | 21 | 35.4 | * |
| B | 1.95 | 0.008 | — | — | — | — | 1198 | 1 | 40.9 | *** |
| C | 1.77 | .025 | 1026 | 1027 | 1304 | 1294 | 1298 | 31 | 34.9 | ** |
| D | 1.92 | .027 | 1027 | 1049 | 1274 | 1279 | 1284 | 29 | 37.3 | ** |
| E | 2.55 | — | 1071 | 1118 | 1180 | 1214 | 1227 | 19 | 50.3 | ** |
| F | 2.75 | .003 | — | — | — | — | — | 0 | 50.8 | *** |

Temperatures in ° C.
* Of the invention
** Chemistry of the invention
*** Not of the invention

What is claimed is:

1. A method for producing a non-oriented electrical steel comprising the steps of:

(a) preparing a non-oriented electrical steel melt having a composition in weight % comprising:
up to about 6.5% silicon,
up to about 5% chromium,
up to about 0.05% carbon,
up to about 3% aluminum,
up to about 3% manganese, and
the balance being substantially iron and residuals;

(b) casting a steel slab from said steel melt;

(c) heating said steel slab to a temperature less than $T_{max}$ and greater than $T_{min}$ as defined by:

$$T_{min}, ° C. = 921 - 5998(\%C) - 106(\%Mn) + 135(\%P) + 78.5(\%Si) + 107(\%Al) - 11.9(\%Cr) + 896(\%N) + 8.33(\%Cu) - 146(\%Ni) + 173(\%Mo)$$

$$T_{max}, ° C. = 1479 + 3480(\%C) + 158(\%Mn) - 347(\%P) - 121(\%Si) - 275(\%Al) + 1.42(\%Cr) - 195(\%N) + 44.7(\%Cu) + 140(\%Ni) - 132(\%Mo)$$

(d) hot rolling said slab to a hot rolled strip wherein said hot rolling provides a nominal strain of at least 700 using the equation:

$$\varepsilon_{nominal} = \left[\frac{2\pi n}{t_i}\sqrt{D(t_i - t_f)}\left(1.25 - \frac{t_f}{4t_i}\right)\right]^{0.15} \exp\left(\frac{7616}{T}\right)\ln\left(\frac{t_i}{t_f}\right); \text{ and,}$$

(e) finish annealing said strip at a temperature less than T as defined by:

$T$, ° C.=759−4430(%C)−194(%Mn)+445(%P)+181(%Si)+378(%Al)−29.0(%Cr)−48.8(%N)−68.1(%Cu)−235(%Ni)+116(%Mo).

2. The method of claim 1 wherein the finish annealing temperature is less than T as defined by:

$T$, ° C.=921−5998(%C)−106(%Mn)+135(%P)+78.5(%Si)+107(%Al)−11.9(%Cr)+896(%N)+8.33(%Cu)−146(%Ni)+173(%Mo).

3. The method of claim 1 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

4. The method of claim 2 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

5. The method of claim 1 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up to about 0.007% selenium;
up to about 0.002% nitrogen, and
the balance being substantially iron and residuals.

6. The method of claim 2 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up to about 0.007% selenium;
up to about 0.002% nitrogen, and
the balance being substantially iron and residuals.

7. The method of claim 1 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.01% vanadium.

8. The method of claim 2 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.01% vanadium.

9. A method for producing a non-oriented electrical steel comprising the steps of:
(a) preparing a non-oriented electrical steel melt having a composition in weight % comprising:
up to about 6.5% silicon,
up to about 5% chromium,
up to about 0.05% carbon,
up to about 3% aluminum,
up to about 3% manganese, and
the balance being substantially iron and residuals;
(b) casting a steel slab from said steel melt;
(c) heating said steel slab to a temperature less than $T_{max}$ and greater than $T_{min}$ as defined by:
ti $T_{min}$, ° C.=759−4430(%C)−194(%Mn)+445(%P)+181(%Si)+378(%Al)−29.0(%Cr)−48.8(%N)−68.1(%Cu)−235(%Ni)+116(%Mo)
ti $T_{max}$, ° C.=1633+3970(%C)+236(%Mn)−685(%P)−207(%Si)−455(%Al)+9.64(%Cr)−706(%N)+55.8(%Cu)+247(%Ni)−156(%Mo)
(d) hot rolling said slab to a hot rolled strip wherein said hot rolling provides a nominal strain of at least 700 using the equation:

$$\varepsilon_{nominal} = \left[\frac{2\pi n}{t_i}\sqrt{D(t_i - t_f)}\left(1.25 - \frac{t_f}{4t_i}\right)\right]^{0.15} \exp\left(\frac{7616}{T}\right)\ln\left(\frac{t_i}{t_f}\right); \text{ and,}$$

(e) finish annealing said strip at a temperature less than $T_{min}$ as defined by:
ti $T_{min}$, ° C.=759−4430(%C)−194(%Mn)+445(%P)+181(%Si)+378(%Al)−29.0(%Cr)−48.8(%N)−68.1(%Cu)−235(%Ni)+116(%Mo).

10. The method of claim 9 wherein the finish annealing temperature is less than T as defined by:
ti $T$, ° C.=921−5998(%C)−106(%Mn)+135(%P)+78.5(%Si)+107(%Al)−11.9(%Cr)+896(%N)+8.33(%Cu)−146(%Ni)+173(%Mo).

11. The method of claim 9 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

12. The method of claim 10 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

13. The method of claim 9 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up to about 0.007% selenium;
up to about 0.002% nitrogen, and
the balance being substantially iron and residuals.

14. The method of claim 10 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up to about 0.007% selenium;
up to about 0.002% nitrogen, and
the balance being substantially iron and residuals.

15. The method of claim 9 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.01% vanadium.

16. The method of claim 10 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.0 1% vanadium.

17. A method for producing a non-oriented electrical steel comprising the steps of:
(a) preparing a non-oriented electrical steel melt having a composition in weight % comprising:
up to about 6.5% silicon,
up to about 5% chromium,
up to about 0.05% carbon,
up to about 3% aluminum,
up to about 3% manganese, and
the balance being substantially iron and residuals;
(b) casting a steel slab from said steel melt;
(c) heating said steel slab to a temperature less than $T_{max}$ as defined by:

$$T_{max},\ ^\circ\text{C.}=1463+3401(\%C)+147(\%Mn)-378(\%P)-109(\%Si)-248(\%Al)+0.79(\%Cr)-78.8(\%N)+28.9(\%Cu)+143(\%Ni)-22.7(\%Mo)$$

(d) hot rolling said slab to a hot rolled strip wherein said hot rolling provides a nominal strain of at least 700 using the equation:

$$\varepsilon_{nominal}=\left[\frac{2\pi n}{t_i}\sqrt{D(t_i-t_f)}\left(1.25-\frac{t_f}{4t_i}\right)\right]^{0.15}\exp\left(\frac{7616}{T}\right)\ln\left(\frac{t_i}{t_f}\right);\ \text{and,}$$

(e) finish annealing said strip at a temperature less than $T_{min}$ as defined by:

$$T_{min},\ ^\circ\text{C.}=759-4430(\%C)-194(\%Mn)+445(\%P)+181(\%Si)+378(\%Al)-29.0(\%Cr)-48.8(\%N)-68.1(\%Cu)-235(\%Ni)+116(\%Mo).$$

18. The method of claim 17 wherein the finish annealing temperature is less than T as defined by:

$$T,\ ^\circ\text{C.}=921-5998(\%C)-106(\%Mn)+135(\%P)+78.5(\%Si)+107(\%Al)-11.9(\%Cr)+896(\%N)+8.33(\%Cu)-146(\%Ni)+173(\%Mo).$$

19. The method of claim 17 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

20. The method of claim 18 wherein the non-oriented electrical steel melt comprises:
about 1% to about 3.5% silicon,
about 0.1% to about 3% chromium,
up to about 0.01% carbon,
up to about 1% aluminum,
about 0.1% to about 1% manganese,
up to about 0.01% of a metal selected from the group consisting of sulfur, selenium and mixtures thereof,
up to about 0.01% nitrogen, and
the balance being substantially iron and residuals.

21. The method of claim 17 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up to about 0.007% selenium;
up to about 0.002% nitrogen, and
the balance being substantially iron and residuals.

22. The method of claim 18 wherein the non-oriented electrical steel melt comprises:
about 1.5% to about 3% silicon,
about 0.15% to about 2% chromium,
up to about 0.005% carbon,
up to about 0.5% aluminum,
about 0.1% to about 0.35% manganese,
up to about 0.005% sulfur;
up about 0.007% selenium;
up to about 0.002% nitrogen, and
the balance being substantially iron and residuals.

23. The method of claim 17 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.01% vanadium.

24. The method of claim 18 wherein the non-oriented electrical steel melt further comprises up to about 0.15% antimony, up to about 0.005% niobium, up to about 0.25% phosphorus, up to about 0.15% tin, up to about 0.01% sulfur and/or selenium, and up to about 0.01% vanadium.

* * * * *